US005722847A

United States Patent [19]

Haag

[11] Patent Number: 5,722,847

[45] Date of Patent: Mar. 3, 1998

[54] TWIST-LOCK CONNECTOR FOR ELECTRICAL PLUG AND WALL SOCKET

[75] Inventor: Philip E. Haag, Redwood City, Calif.

[73] Assignee: Maverick Global Enterprises, LLC, Woodside, Calif.

[21] Appl. No.: 679,124

[22] Filed: Jul. 12, 1996

[51] Int. Cl.[6] ..... H01R 4/38

[52] U.S. Cl. ..... 439/320; 439/314

[58] Field of Search ..... 439/320, 321, 439/369, 370, 372, 367, 368, 371, 314

[56] References Cited

U.S. PATENT DOCUMENTS

| | | | |
|---|---|---|---|
| 839,224 | 12/1906 | Stokes . | |
| 2,517,364 | 8/1950 | Torresen . | |
| 3,461,417 | 8/1969 | Schumacher et al. | 339/14 |
| 3,605,059 | 9/1971 | Lipinski | 339/14 L |
| 3,742,427 | 6/1973 | Ballard | 339/60 M |
| 3,891,289 | 6/1975 | Hanke | 339/14 P |
| 4,318,578 | 3/1982 | Ericson et al. | 339/14 P |
| 4,449,776 | 5/1984 | Carmo et al. | 339/91 R |
| 4,691,974 | 9/1987 | Pinkerton et al. | 439/367 |
| 4,911,654 | 3/1990 | Blaetz . | |
| 5,087,209 | 2/1992 | Faucher | 439/320 |
| 5,211,570 | 5/1993 | Bitney | 439/320 |
| 5,299,951 | 4/1994 | Blaetz . | |
| 5,344,333 | 9/1994 | Haag | 439/320 |
| 5,393,243 | 2/1995 | Carmo | 439/369 |

*Primary Examiner*—Neil Abrams
*Assistant Examiner*—Yong Ki Kim
*Attorney, Agent, or Firm*—Feix & Feix

[57] ABSTRACT

A twist-lock connector assembly for securing an engaged electrical plug to an electrical outlet which includes a rotatable cylindrical sleeve disposed enclosing an electrical plug and a modified cover plate for replacing the conventional cover plate of an electrical outlet, such as a wall socket or a portable power box. The prong end of the sleeve includes a plurality of radially inwardly projecting nubs provided along an inner cylindrical surface thereof. The cover plate includes an upstanding cylindrical wall disposed about a periphery of each socket access opening. A plurality of thread members are formed on the exterior surface of each upstanding cylindrical wall and which are designed to matingly engage the nubs on the inner cylindrical surface of the sleeve as the sleeve is twist-rotated over the upstanding cylindrical wall. In use, the electrical plug is inserted into the socket portion of the wall outlet and the cylindrical sleeve is rotated about a ¼ turn. This causes the inner disposed nubs of the sleeve to lockingly engage the outer disposed threads of the upstanding cylindrical wall of the cover plate. The electrical plug is prevented from being accidentally pulled loose from the outlet by its connection with the second sleeve end of the cylindrical sleeve.

16 Claims, 1 Drawing Sheet

LOCK
UN-LOCK
LOCK
UN-LOCK

TWIST-LOCK CONNECTOR FOR ELECTRICAL PLUG AND WALL SOCKET

TECHNICAL FIELD

The present invention relates to locking apparatus for electrical connectors, and more particularly, to a twist-lock connector assembly for maintaining engagement between an engaged electrical plug and a wall socket.

BACKGROUND OF THE INVENTION

When using electric powered appliances or power tools, it is necessary to maintain firm engagement between an engaged electrical plug and a wall outlet or power box in order to ensure an uninterrupted source of power to the appliance or power tool. Unintentional unplugging of an engaged electric power cord from a wall outlet can cause frustration and contribute to decreased productivity. For example, most people have experienced the common frustration of having the power cord of a vacuum cleaner unintentionally pulled loose from the wall socket several times while vacuuming. As a further example, a computer plug which comes loose from its connection to a wall socket can result in loss of data. As another example, construction workers at a job site experience production losses each time they must replug a power tool that has come loose from a wall socket or power box during use.

Various techniques and devices have been proposed for ensuring engagement between an engaged electrical plug and wall outlet or power box. For example, in accordance with one prior art technique, the electrical plug is provided with a metal loop or fork tongue flange which is designed to be fastened by a screw to the center hole of the cover plate of the electrical outlet.

A disadvantage with this technique is that the cover plate center screw be loosened each time the electric plug is to be engaged or disengaged from the wall socket. Thus, this technique is extremely impractical for uses in which the electric plug will only be engaged for short time periods, such as is the case with the use of vacuum cleaners, gardening tools, power tools, etc. Further, this technique requires use of a screw driver each time the electric plug is to be locked in engagement with and unlocked from engagement with the wall socket. Further still, in the case where the electric plug to be engaged is a three prong plug, the presence of the third "ground" prong of the three prong plug means that the plug can only be inserted into the wall socket in one orientation. Since there is usually only one center screw hole located between the two socket access openings of the cover plate, only one electric plug having the metal loop or forked tongue flange can be screwed in place to the wall socket at a time. Accordingly, a connector arrangement for securing an engaged electric plug to a wall socket which does not require use of additional tools to make the locking connection and which can lockingly engage more than one electric plug to the respective socket portions of an electrical outlet at a time would be a big advance in the art.

In the case of exposed outlet boxes of the type commonly found on boat docks, it is the common practice to use leather straps, string or even tape to ensure that an engaged electric plug remains connected to the socket portion of the outlet box. It is also the common practice to bend or deform the conductor prongs of an electric plug to create a tighter fit inside the outlet. Obviously such practices are only temporary fixes and do not provide a long lasting secure engagement between and engaged electric plug and an electrical outlet.

My previous approach to solving this problem is disclosed in U.S. Pat. No. 5,344,333. This approach proposes to use a rotatable cylindrical sleeve for twist-locking an engaged electric plug to a cover plate of a wall outlet. In this design the cylindrical sleeve is provided with a first end adapted for snap fit insertion within a socket opening of the cover plate and a second end provided with grooves along an inner cylindrical surface thereof. The electric plug is provided with a circular face plate having threads formed along its outer surface. In use, the plug is engaged within the socket and the sleeve is rotated such that the grooves of the sleeve lockingly engage with the threads of the face plate on the electric plug.

While my earlier design works well and offers many advantages over the prior art techniques discussed above, there is still a problem since dirt and debris tends to collect in the sleeve over time and this can inhibit positive locking engagement. Also, in my earlier design, two hands are required to complete the locking engagement between the engaged electrical plug and the wall outlet. Accordingly, a twist-locking connector arrangement which overcomes these problems would be extremely desirable.

SUMMARY OF THE INVENTION

It is therefore a principle object of the present invention to provide a simple, low cost twist-lock connector assembly for securing an engaged electrical plug to a wall outlet or power box.

It is a related object of the invention to provide a twist-lock connector assembly of the type described herein which permits convenient single handed-locking operation and which does not require any tools to perform the locking operation.

Briefly, in accordance with a preferred embodiment, the twist-lock connector assembly of the present invention comprises two primary components including an axially rotatable cylindrical sleeve for enclosing the insulator body portion of an electrical plug and a modified cover plate which replaces the conventional cover plate that covers the metal electrical box of a wall socket. The cylindrical sleeve has a first sleeve end that extends a distance beyond the insulator body portion of the electrical plug in the direction of the protruding electrical conductors or prongs and a second sleeve end that is rotatably mounted to the insulator body portion of the electric plug. In use, the cylindrical sleeve is freely rotatable about the long axis of the electric plug. The first sleeve end includes a plurality of radially inwardly projecting nubs provided along an inner cylindrical surface thereof.

The modified cover plate is similar in design to a conventional cover plate except that it includes an upstanding cylindrical wall disposed about a periphery of each socket access opening. Each of the upstanding cylindrical walls is provided with a plurality of spaced apart discontinuous thread members formed along their respective exterior wall surfaces. The diameter of each upstanding cylindrical wall is dimensioned to provide a close tolerance fit within the first sleeve end of the cylindrical sleeve. Also, the thread members on the exterior wall surfaces are designed to matingly engage the nubs on the inner cylindrical surface of the first sleeve end as the sleeve is twist-rotated over the upstanding cylindrical wall.

In use, the electrical plug is inserted into the socket portion of the wall outlet and the cylindrical sleeve is rotated about a ¼ turn. This causes the inner disposed nubs of the sleeve to lockingly engage the outer disposed threads of the upstanding cylindrical wall of the cover plate. The electrical plug is prevented from being accidentally pulled loose from the outlet by its connection with the second sleeve end of the cylindrical sleeve.

An advantage of the present invention over of the thread-in-groove twist-lock connector designs of the prior art is that the use of projecting nubs on the sleeve instead receiving grooves substantially eliminates the aforementioned problem of dirt and debris collecting in the sleeve and inhibiting positive twist-locking engagement of the locking structure.

The location of the rotatable sleeve on the electrical plug also advantageously facilitates single-handed twist-locking operation by a user.

In an alternate embodiment of the invention, the twist-lock connector assembly comprises three components: namely, a cover plate for attaching to a wall socket, a shortened cylindrical sleeve, and an adapter or face plate that attaches to or forms an integral part of the prong end of the electrical plug. The shortened cylindrical sleeve includes a first sleeve end adapted for snap fit insertion into the socket access openings of the cover plate and a second sleeve end having a plurality of spaced apart nubs disposed along an inner cylindrical surface thereof. Once snap fitted in place on the cover plate, the shortened cylindrical sleeve is permitted to axially rotate with respect to the cover plate. The face plate on the prong end of the electrical plug is provided with a plurality of external threads. In use, the electrical plug is plugged into the socket portion of the wall outlet and the shortened cylindrical sleeve is rotated so that the internally disposed nubs on the second sleeve inner cylindrical surface lockingly engage the external threads on the face plate of the electrical plug.

Another advantage afforded by the present invention is the extended operating life and reliability of the electrical contacting components of the electrical plug and socket assemblies since the twist-lock feature of the connector assembly substantially reduces tensional forces on the electrical plug and thereby prevents excess wear of the electrical contact surfaces of the female socket and male electrical plug assemblies.

Methods and apparatus which incorporate the features described above and which are effective to function as described above constitute specific objects of this invention.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWING VIEWS

The accompanying drawings incorporated in and forming a part of the specification, illustrate several aspects of the present invention, and together with the description serve to explain the principles of the invention.

Figures 1, 2, 3, 4, 5, 6:
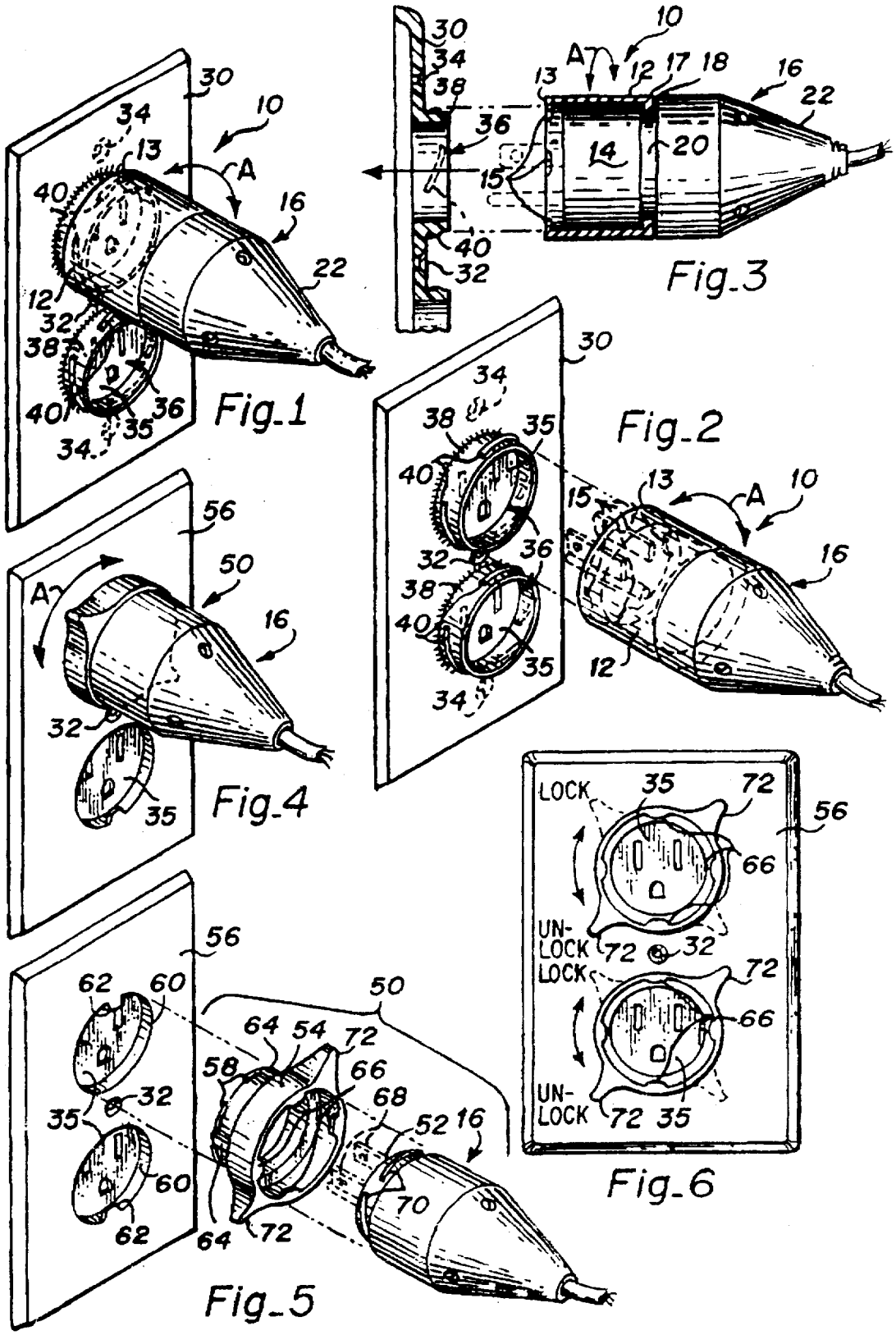
FIG. 1 is an isometric perspective view of a twist-lock connector assembly in accordance with one embodiment of the present invention and which shows an electrical plug in locking engagement with a wall socket.
FIG. 2 is an isometric perspective view similar to that of FIG. 1 but showing the electrical plug disengaged from the wall socket.
FIG. 3 is a cross sectional side elevation view of the twist-lock connector assembly of FIG. 2.
FIG. 4 is an isometric perspective view of a twist-lock connector assembly in accordance with a second embodiment of the present invention and which shows an electrical plug in locking engagement with a wall socket.
FIG. 5 is an isometric perspective view of a second embodiment of the present invention similar to FIG. 4 but showing the electrical plug disengaged from the wall socket.
FIG. 6 is a front elevational view of a wall socket cover plate constructed in accordance with a second embodiment of the present invention.

Reference will now be made in detail to various present preferred embodiments of the invention, examples of which are illustrated in the accompanying drawings.

DETAILED DESCRIPTION OF THE PREFERRED EMBODIMENTS

A twist-lock connector assembly for use in maintaining engagement between and engaged electrical plug and a wall socket constructed in accordance with one embodiment of the present invention is generally designated by reference numeral 10 in FIGS. 1–3.

The twist-lock connector assembly 10 includes a generally cylindrical sleeve 12 which encloses the insulator body portion 14 of the electrical plug 16. As best seen in FIG. 3, the sleeve 12 includes a first sleeve end 13 which extends in a forward direction a distance beyond the insulator body portion 14 such that it partially encloses the electrical conductors or prongs (shown in phantom) of the electrical plug 16. The first sleeve end 13 has an inner cylindrical surface provided with a plurality of evenly spaced apart nubs 15.

The sleeve 12 also includes a second sleeve end 17 having rotatable mounting means for rotatably mounting the sleeve 12 to the electrical plug 16 so that the sleeve 12 is freely axially rotatable about the long axis of the electrical plug 16 as indicated by directional arrow A. The rotatable mounting means also serve to attach or tether the sleeve 12 to the electrical plug 16 in a way which keeps the sleeve 12 in a preferred axial relationship with the insulator body portion 14 as shown. In a preferred embodiment, the rotatable mounting means include a notched key way 18 disposed at a rearwardmost end of the sleeve 12. The key way 18 is adapted to be slidably received within an annular slot or gap 20 provided to the electrical plug 16. In this example, the gap 20 is formed by the presence of the insulator body portion 14 on one side and a fixed conical housing portion 22 on the other side.

There are, of course, many other possible alternative structural arrangements for rotatably mounting the sleeve to the electrical plug in a way that keeps the sleeve in a desired axial relationship with the electrical plug (i.e., where the first sleeve end 13 with the nubs 15 is positioned just forwardly of the insulator body portion 14 of the electrical plug 16). For example, the conical end portion 22 may be formed integral with the cylindrical sleeve 12 (in this case the conical end portion would not be fixed or held by screws to the electrical plug 16). The tapered end of the conical end portion of such a modified sleeve would include a hole for receiving the power cord of the electrical plug. An additional keeper, such as a ring or similar member (not shown) could be installed on the power cord to restrain rearward displacement of the conical end portion relative to the electrical plug 16 and thus keep the sleeve in a desired axial relationship with the electrical plug.

The twist-lock connector assembly 10 also includes a modified cover plate 30 which replaces the conventional cover plate of a wall socket. The modified cover plate 30 preferably includes a center hole 32 for receiving a fastening screw (not shown) to secure the cover plate 30 to the conventional center screw location of the wall socket. This is best seen in FIGS. 2 and 3. Alternatively, as is shown in FIG. 1, the cover plate may include top and bottom screw holes 34 (shown in phantom) for attaching the cover plate 30 to the top and bottom screw mounts of the metal box that houses the electrical socket portions 35 of the wall socket.

The cover plate 30 is provided with socket access openings 36 which are formed with a surrounding upstanding perimeter wall 38. Each wall 38 defines a cylindrical opening having a diameter sized for close tolerance fit within the cylindrical opening of the first sleeve end 13. The outer surface of wall 38 includes a plurality of external threads 40 which, in use, engage the nubs 15 of the first sleeve end 13 as the electrical plug is inserted into the socket portion 35 and the sleeve 12 is rotated in a locking. In this manner the rotatable sleeve 12 is twist-locked onto the grooved upstanding cylindrical wall 38 of the cover plate 30 and therefore provides a positive locked engagement between the engaged electrical plug 16 and the socket portion 35 of the wall socket. To disengage the electrical plug from the wall socket, the sleeve 12 is simply rotated in a reverse orientation which, in turn, frees the nubs 15 from locking engagement with the external threads 40 of the upstanding cylindrical wall 38 of the cover plate 30.

In a preferred embodiment of the invention, there are four nubs 15 and there are four discontinuous threads 40 which are arranged in a conventional four (4) point thread configuration of the cross hair type. This simple arrangement permits twist-locking and unlocking operation with only about a ¼ turn of the sleeve in either direction required. A greater number of threads and nubs may be used if desired.

A twist-lock connector assembly constructed in accordance with a second embodiment of the present invention is designated generally by reference numeral 50 in FIGS. 4 and 5.

The twist-lock connector assembly 50 includes: a face plate 52 attached to or formed integral with a prong end of an electrical plug 16; a modified cover plate 56 for replacing the conventional cover plate of a wall socket or power box; and a cylindrical sleeve 54 for rotatably securing the face plate 52 to the cover plate 56. The sleeve 54 is a modified and shortened version of the sleeve 13 of the embodiment described above with reference to FIGS. 1–3 and includes a first sleeve end having perimeter rib segments 58 adapted for snap fit insertion within the socket access openings 60 of the cover plate 56. Each of the socket access openings 60 preferably include at least one inwardly extended tab or stop member 62 which, in use, abuts against axial stops 64 provided to the first sleeve end to limit the range of axial rotation of the sleeve 54 within the socket access openings 60. This feature will be discussed in more detail below with reference to FIG. 6.

The sleeve 54 also includes a second sleeve end having an inner cylindrical surface formed with a plurality of spaced nubs 66. The inner cylindrical surface of the sleeve second end is sized for close tolerance fit over the face plate 52 of the electrical plug 16. Upon engagement of the conductors elements 68 (shown in phantom) of the electrical plug 16 by the corresponding receiving slots of the socket portion 35 of the wall socket, the sleeve is twist-rotated as indicated by arrow A in FIG. 4. This causes the nubs 66 to lockingly engage external threads 70 provided on the face plate 52, thereby locking the electrical plug 16 to the cover plate 56. The rotatable sleeve 54 preferably includes finger tabs 72 to facilitate the twist-lock operation by a user.

Referring now to FIG. 6, the two finger tabs 72 on each of the sleeves 54 are preferably oriented diagonally opposite to one another such that they lie at about the two o'clock and eight o'clock positions of the socket access openings when the sleeve 54 is in the unlocked position. When the sleeve is rotated to the locked position, the finger tabs 72 move to about the four o'clock and ten o'clock positions, respectively. A greater or lesser range of axial rotation of the sleeve 54 within each socket access opening 60 can be made by adjusting the placement of the axial stops 64 of the sleeve first end which abut against the tab 62 at the fully locked and unlocked positions of the rotatable sleeve. The placement of the axial stops 64 with respect to finger tabs 72 of each sleeve is also selected to ensure that the finger tabs of the top and bottom sleeve do not overlap and interfere with one another.

While I have illustrated and described the preferred embodiments of my invention, it is to be understood that these are capable of variation and modification, and I therefore do not wish to be limited to the precise details set forth, but desire to avail ourselves of such changes and alterations as fall within the purview of the following claims. For instance, while the cover plate of the above embodiments is described as being suitable for use in replacing the conventional cover plate of a wall socket, it is understood that the cover plate of the present invention can also be used in combination with portable power boxes of the type used at construction sites as well as with other similar temporary power systems.

What is claimed is:

1. A connector assembly for maintaining engagement between an engaged electrical plug and a wall socket, the connector assembly comprising:

a) a cover plate for enclosing a wall socket, said cover plate including at least one circular opening for allowing plug-in access by an electrical plug to a socket portion of said wall socket;

b) said cover plate including an upstanding cylindrical wall disposed about a periphery of said at least one opening, said upstanding cylindrical wall having a plurality of thread members formed along an outer surface thereof; and c) a sleeve for enclosing an electrical plug including a first sleeve end disposed adjacent a prong end of said electrical plug and a second sleeve end; wherein:

i) said first sleeve end having an inner cylindrical surface comprising a plurality of spaced apart, radially inwardly projecting nubs for lockingly engaging said threads of said cover plate upon insertion of said electrical plug within said socket portion of said wall socket and rotation of said sleeve with respect to said cover plate;

ii) said second sleeve end provided with rotatable mounting means for rotatably mounting said sleeve to said electrical plug to enable said sleeve to freely axially rotate about said electrical plug.

2. The invention as recited in claim 1, wherein said plurality of thread members disposed along said outer surface of said upstanding cylindrical wall of said cover plate include four discontinuous threads arranged in a four point thread configuration of the cross hair type.

3. The invention as recited in claim 1, wherein said rotatable mounting means comprises a notched key way adapted for slidable engagement within a circumferential gap provided in an exterior surface of said electrical plug.

4. The invention as recited in claim 3, wherein said plurality of thread members disposed along said outer surface of said upstanding cylindrical wall of said cover plate include four discontinuous threads arranged in a four point thread configuration of the cross hair type.

5. A connector assembly for maintaining engagement between an engaged electrical plug and a wall socket, the connector assembly comprising:

a) a cover plate for enclosing a wall socket, said cover plate including at least one circular opening for allowing plug-in access by an electrical plug to a socket portion of said wall socket;

b) said cover plate including an upstanding cylindrical wall disposed about a periphery of said at least one opening, said upstanding cylindrical wall having a plurality of thread members formed along an outer surface thereof; and c) a sleeve for enclosing an electrical plug including a first sleeve end disposed adjacent a prong end of said electrical plug and a second sleeve end; wherein:

i) said first sleeve end having an inner cylindrical surface comprising a plurality of spaced apart, radially inwardly projecting nubs for lockingly engaging said threads of said cover plate upon insertion of said electrical plug within said socket portion of said wall socket and rotation of said sleeve with respect to said cover plate;

ii) said second sleeve end provided with rotatable mounting means for rotatably mounting said sleeve to said electrical plug to enable said sleeve to freely axially rotate about said electrical plug.

6. The invention as recited in claim 5, wherein said plurality of thread members disposed along said outer surface of said upstanding cylindrical wall of said cover plate.

7. A connector assembly for maintaining engagement between an engaged electrical plug and a wall socket, the connector assembly comprising:

a) an electrical plug including a generally cylindrical body portion disposed adjacent a prong end thereof, said generally cylindrical body portion having an outer surface formed with a plurality of threads members;

b) a cover plate for enclosing a wall socket, said cover plate including at least one circular opening for allowing plug-in access by said electrical plug to a socket portion of said wall socket;

c) a generally cylindrical sleeve including a first sleeve end sized for close tolerance fit over said generally cylindrical body portion of said electrical plug and a second sleeve end adapted for snap fit insertion within said at least one opening of said cover plate, said sleeve being twist rotatable within said at least one opening of said cover plate; and d) nub engaging means provided to an inner cylindrical surface of said first sleeve end for lockingly engaging said threads of said electrical plug upon insertion of said electrical plug within said socket portion of said wall socket and rotation of said sleeve with respect to said electrical plug: and rotation limiting means for limiting the range of twist-lock rotation of said sleeve within said socket access opening of said cover plate so that finger tabs disposed on sleeves disposed within adjacent socket access openings of said cover plate do not overlap and interfere with one another.

8. The invention as recited in claim 7, wherein said plurality of thread members disposed along said prong end of said electrical plug include four discontinuous threads arranged in a four point thread configuration of the cross hair type.

9. The invention as recited in claim 8, said sleeve includes finger tabs to facilitate handling by a user.

10. The invention as recited in claim 7, wherein said hub engaging means comprise at least four spaced apart radially inwardly projecting nubs.

11. A connector assembly for maintaining engagement between an engaged electrical plug and a wall socket, the connector assembly comprising:

a) an electrical plug including a generally cylindrical body portion disposed adjacent a prong end thereof, said generally cylindrical body portion having an outer surface formed with a plurality of threads members;

b) a cover plate for enclosing a wall socket, said cover plate including at least one circular opening for allowing plug-in access by said electrical plug to a socket portion of said wall socket;

c) a generally cylindrical sleeve including a first sleeve end sized for close tolerance fit over said generally cylindrical body portion of said electrical plug and a second sleeve end adapted for snap fit insertion within said at least one opening of said cover plate, said sleeve being twist rotatable within said at least one opening of said cover plate; and d) a plurality of spaced radially inwardly projecting nubs provided to an inner cylindrical surface of said first sleeve end for lockingly engaging said threads of said electrical plug upon insertion of said electrical plug within said socket portion of said wall socket and rotation of said sleeve with respect to said electrical plug.

12. The invention as recited in claim 11, said sleeve includes finger tabs to facilitate handling by a user.

13. The invention as recited in claim 12 which further includes rotation limiting means for limiting the range of twist-lock rotation of said sleeve within said socket access opening of said cover plate so that finger tabs disposed on sleeves disposed within adjacent socket access openings of said cover plate do not overlap and interfere with one another include four discontinuous threads arranged in a four point thread configuration of the cross hair type.

14. The invention as recited in claim 11, wherein said plurality of thread members disposed along said outer surface of said upstanding cylindrical wall of said cover plate include four discontinuous threads arranged in a four point thread configuration of the cross hair type.

15. The invention as recited in claim 14, said sleeve includes finger tabs to facilitate handling by a user.

16. The invention as recited in claim 15 which further includes rotation limiting means for limiting the range of twist-lock rotation of said sleeve within said socket access opening of said cover plate so that finger tabs disposed on sleeves disposed within adjacent socket access openings of said cover plate do not overlap and interfere with one another.

* * * * *